US008505783B2

(12) United States Patent
Gill et al.

(10) Patent No.: US 8,505,783 B2
(45) Date of Patent: Aug. 13, 2013

(54) SQUEEZABLE BOTTLE

(75) Inventors: Yoram Gill, Haifa (IL); Roee Bigger, Rishon Lezion (IL); Yariv Sade, Zur Yigal (IL); Arik Yuval, Zur Yigal (IL)

(73) Assignee: Source Vagabond Systems Ltd., Tirat Hacarmel (IL)

( * ) Notice: Subject to any disclaimer, the term of this patent is extended or adjusted under 35 U.S.C. 154(b) by 409 days.

(21) Appl. No.: 12/835,164

(22) Filed: Jul. 13, 2010

(65) Prior Publication Data

US 2012/0012617 A1 Jan. 19, 2012

(51) Int. Cl.
*B65D 37/00* (2006.01)

(52) U.S. Cl.
USPC ..... 222/212; 222/211; 222/213; 222/464.3; 222/535; 220/705; 215/388

(58) Field of Classification Search
USPC ..... 222/212–215, 464.1, 464.3, 464.5, 222/519–520, 525, 523, 533–535, 530, 211; 215/379, 380, 381–382, 387–388; 220/707–709, 705
See application file for complete search history.

(56) References Cited

U.S. PATENT DOCUMENTS 4,448,316 A * 5/1984 Hiroshige ..... 215/388
4,830,205 A * 5/1989 Hammond et al. ..... 215/11.3
4,976,364 A * 12/1990 Solomon ..... 215/229
5,029,719 A * 7/1991 Solomon ..... 215/229
5,174,469 A * 12/1992 Policapelli ..... 220/710
5,282,541 A 2/1994 Chen
5,310,068 A * 5/1994 Saghri ..... 215/386
5,615,791 A 4/1997 Vatelot et al.
5,762,230 A 6/1998 Policappelli
5,823,422 A * 10/1998 Collier et al. ..... 229/103.1
6,006,952 A * 12/1999 Lucas ..... 222/211
6,247,619 B1 6/2001 Gill et al.
6,311,861 B1 * 11/2001 Policappelli ..... 220/669
6,354,458 B1 * 3/2002 Policappelli ..... 220/674
6,523,711 B1 * 2/2003 Hughes et al. ..... 220/709
6,547,105 B1 * 4/2003 Seelhofer et al. ..... 222/205
6,598,755 B1 * 7/2003 Pedulla et al. ..... 215/382
7,097,065 B2 * 8/2006 Yoneoka et al. ..... 220/709
7,802,691 B2 * 9/2010 Mušalek ..... 215/381
D658,993 S * 5/2012 Gill et al. ..... D9/500
2008/0237233 A1 10/2008 Choi et al.
2008/0251492 A1 10/2008 Shi
2010/0163568 A1 7/2010 Mucci et al.
2010/0170839 A1 7/2010 Kohl

OTHER PUBLICATIONS

International Search Report for PCT Application No. PCT/IL2011/000545 mailed on Dec. 19, 2011.

* cited by examiner

*Primary Examiner* — Frederick C Nicolas
(74) *Attorney, Agent, or Firm* — Pearl Cohen Zedek Latzer, LLP

(57) ABSTRACT

A squeezable bottle is disclosed. The squeezable bottle includes a pliable bottle skin, an outlet and a spinal assembly within the pliable skin, for providing longitudinal rigidity along an elongated axis of the bottle.

14 Claims, 7 Drawing Sheets

SQUEEZABLE BOTTLE

FIELD OF THE INVENTION

The present invention relates to hydration systems. More specifically the present invention relates to a squeezable bottle.

BACKGROUND

The US is the largest consumer market for plastic bottled water in the world, followed by Mexico, China, and Brazil. In 2008, U.S. plastic bottled water sales topped 8.6 billion gallons for 28.9% of the U.S. liquid refreshment beverage market, exceeding sales of all other beverages except carbonated soft drinks, followed by fruit juices and sports drinks.

As recycling rates remain dismally low, making bottles requires virgin materials. It takes significant amount of oil and water just to manufacture a one-liter bottle. Extrapolating this for the developed world where more then 2 million tones of plastic are used to bottle water each year leads to the realization that the drinking bottle industry is undoubtedly a big oil consuming and greenhouse gas emitting industry for what are essentially single-use plastic bottles.

A reusable drink bottle was disclosed in US Patent application 2008/0237233 (Choi et al). The drink bottle has a cap assembly that includes a drinking spout and a bite actuated mouthpiece.

A flexible reusable container for storing and dispensing liquids is disclosed in U.S. Pat. No. 6,247,619 (Gill et. Al). The flexible reusable container is designed for extreme outdoor activities such as jogging, cycling, mountaineering and camping. The flexible container has a liquid dispensing means that allows drinking liquids from a flexible container without having to use one's hands.

It is an object of the present invention to provide a novel design for a squeezable bottle that may be used in daily activities out of home.

It is yet another object of the present invention to provide a squeezable bottle with a retractable mouthpiece which is easily used single-handed.

Yet another object of the present invention is to provide a squeezable bottle which may be reusable.

It is yet another object of the present invention to provide a squeezable bottle which may be conveniently filled through a large opening.

It is another object of the present invention to provide a reusable, light weight, easy to fill, easy to clean, squeezable bottle made of a tasteless, safe health-wise, recyclable thermoplastic elastomers squeezable bottle.

SUMMARY

According to embodiments of the present invention, there is provided a squeezable bottle which includes a pliable bottle skin, an outlet and a spinal assembly within the pliable skin, for providing longitudinal rigidity along an elongated axis of the bottle.

Furthermore, according to embodiments of the present invention, the outlet includes a mouthpiece.

Furthermore, according to embodiments of the present invention, the mouthpiece is a retractable mouthpiece.

Furthermore, according to embodiments of the present invention, the retractable mouthpiece has a retracted position in which liquid cannot be dispensed from the bottle through the mouthpiece. The retractable also has a pulled-out position in which liquid may be dispensed through the mouthpiece.

Furthermore, according to embodiments of the present invention, the pliable bottle skin includes a top dome.

Furthermore, according to embodiments of the present invention, the spinal assembly includes a pipe coupled to the mouthpiece.

Furthermore, according to embodiments of the present invention, the spinal assembly includes a base member and a dome support.

Furthermore, according to embodiments of the present invention, a space is provided between a top portion of the skin and dome support, allowing pressing of the top portion of the skin to expose the outlet.

Furthermore, according to embodiments of the present invention, the squeezable bottle includes a bottom sealable opening.

Furthermore, according to embodiments of the present invention, a sealer cap is provided for removably sealing the bottom sealable opening.

Furthermore, according to embodiments of the present invention, a rim and matching groove are provided to interlock the spinal support with the skin.

Furthermore, according to embodiments of the present invention, the squeezable bottle includes a tightening ring for fixing edge of the skin to the spinal assembly.

Furthermore, according to embodiments of the present invention, the spinal assembly is provided with a base member, with one or more gaps allowing refilling the bottle through said one or more gaps.

Furthermore, according to embodiments of the present invention, the squeezable bottle skin is made of a thermoplastic elastomer.

Furthermore, according to embodiments of the present invention, the spinal assembly removable from the bottle.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

DETAILED DESCRIPTION

According to embodiments of the present invention a squeezable bottle is provided.

A squeezable bottle, according to embodiments of the present invention, includes a pliable skin which is easily and conveniently squeezed, and which is provided with a spinal assembly that provides the squeezable bottle with a sturdy spine, allowing convenient lateral squeezing of the bottle, and at the same time providing longitudinal rigidity, along an elongated axis of the bottle.

The squeezable bottle may be equipped with an outlet, such as, for example, in the form of a retractable mouthpiece, which in a retractable state is hidden inside the skin of the bottle, its top flush with respect to the outside surface of the skin, and which may be pulled out conveniently by pressing one's lips against the skin and pulling the mouthpiece using the teeth.

In order to fill the bottle a broad opening is provided at the bottom of the bottle. The bottom opening may be sealable by a sealer cap.

Furthermore, according to embodiments of the present invention the squeezable bottle skin may be made of high quality thermoplastic elastomer (TPE), aiming at providing a light weight, easy to fill, easy to clean, tasteless, safe healthwise, recyclable squeezable bottle.

Reference is now made to the accompanying figures.

Figure 1A:
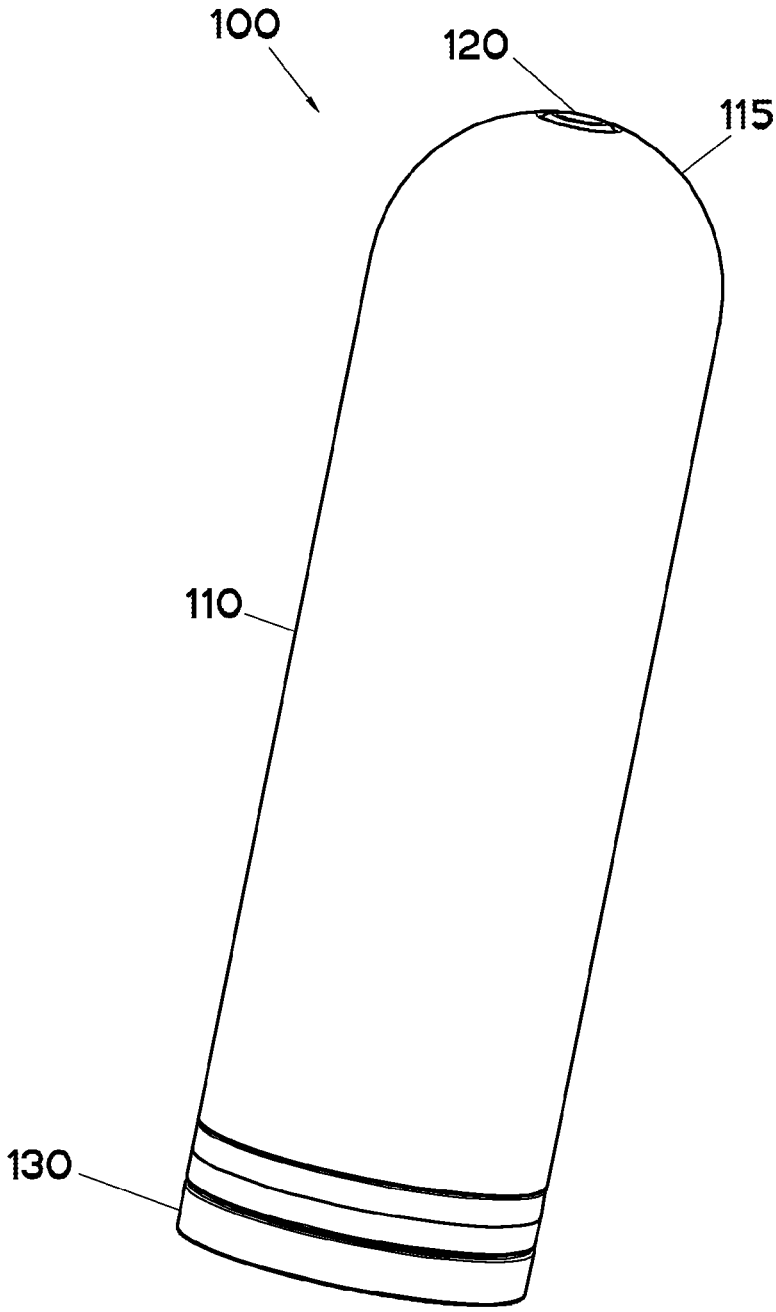
FIG. 1A illustrates a squeezable bottle with a retractable mouthpiece according to embodiments of the present invention, with the mouthpiece in a retracted position.

FIG. 1A illustrates a squeezable bottle with a retractable mouthpiece according to embodiments of the present invention, with the mouthpiece in a retracted position. The squeezable bottle 100 comprises a pliable, collapsible TPE skin 110 that can be hand squeezed laterally across the narrow aspect (the width) of the bottle. A retractable mouthpiece 120 may be easily pulled out by a gentle bite allowing drinking or splashing the content of the bottle without having to tilt the head. A bottom sealer cap 130 is provided for detachably sealing a broad opening at the bottom of the bottle (232, see FIG. 5). The broad bottom opening may be used for refilling the squeezable bottle with liquids.

According to embodiments of the present invention the flexible TPE bottle skin may be manufactured, for example, by injection molding where the TPE material is fed into a heated barrel, mixed, and forced into a mold cavity where it cools and hardens to the attain the form of the mold cavity. Injection molding is ideal for producing high volumes of the same object. Some advantages of injection molding are high production rates, repeatable high tolerances, the ability to use a wide range of materials, low labor cost, minimal scrap losses, and little need for finishing parts after molding.

TPE, sometimes referred to as thermoplastic rubber, is a class of copolymers or physical mixes of polymers (usually plastic and rubber) which includes materials with both thermoplastic and elastomeric properties. TPE's are used where conventional elastomers cannot provide the range of physical properties needed in the product. TPE's are widely used in the automotive industry and in household appliances.

Figure 1B:
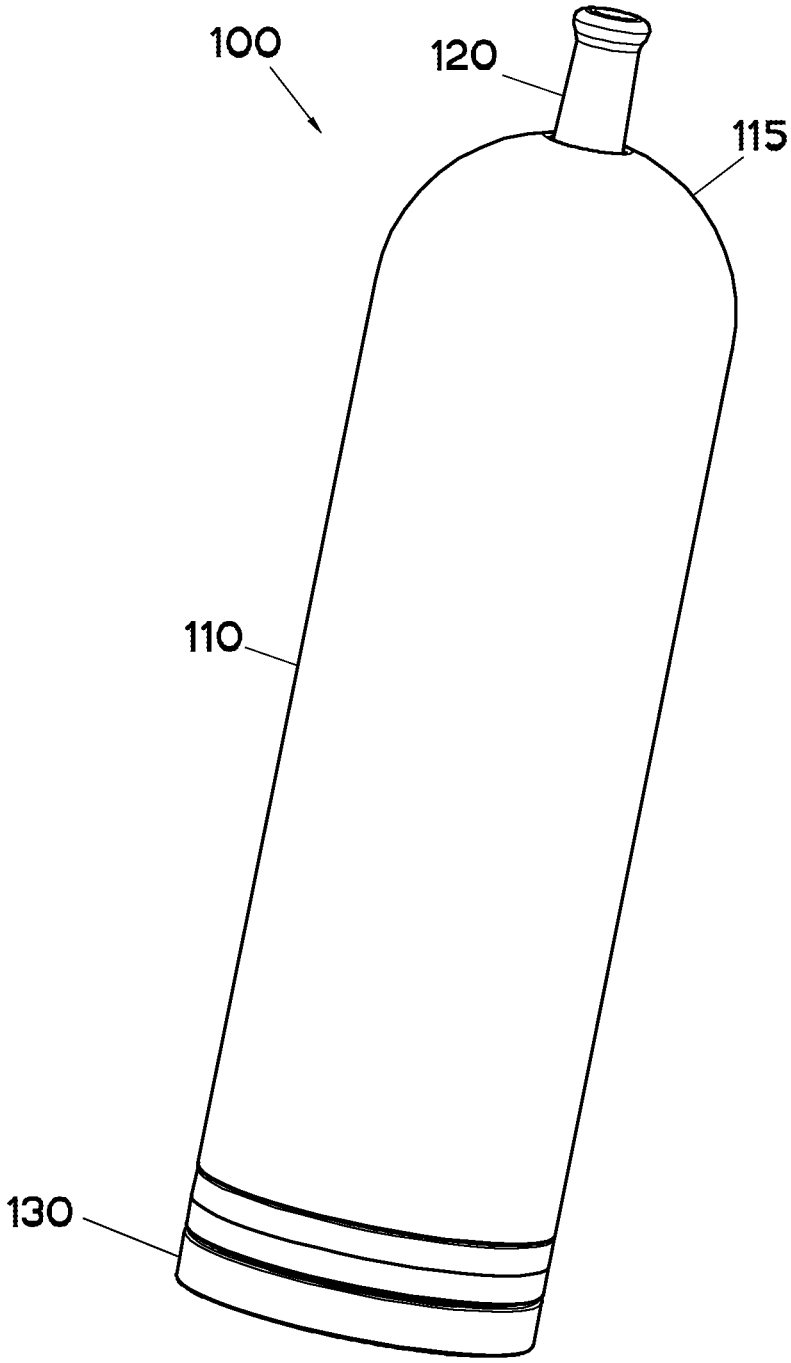
FIG. 1B illustrates a squeezable bottle with a retractable mouthpiece according to embodiments of the present invention, with the mouthpiece in a pulled-out position.

FIG. 1B illustrates a squeezable bottle with a retractable mouthpiece according to embodiments of the present invention, with the mouthpiece in a pulled-out position. Retractable mouthpiece 120 includes a pliable dome structure 115 that gives in when the lips of a user are press against it, exposing the top of mouthpiece 120, allowing pulling the mouthpiece with a gentle bite to the pulled-out, open position. The dome structure 115 includes a hollow chamber vacant of liquid that surrounds the retractable mouthpiece such that the TPE skin in the vicinity of the mouthpiece easily gives in with the lips of the user are pressed against it.

Figure 2A:
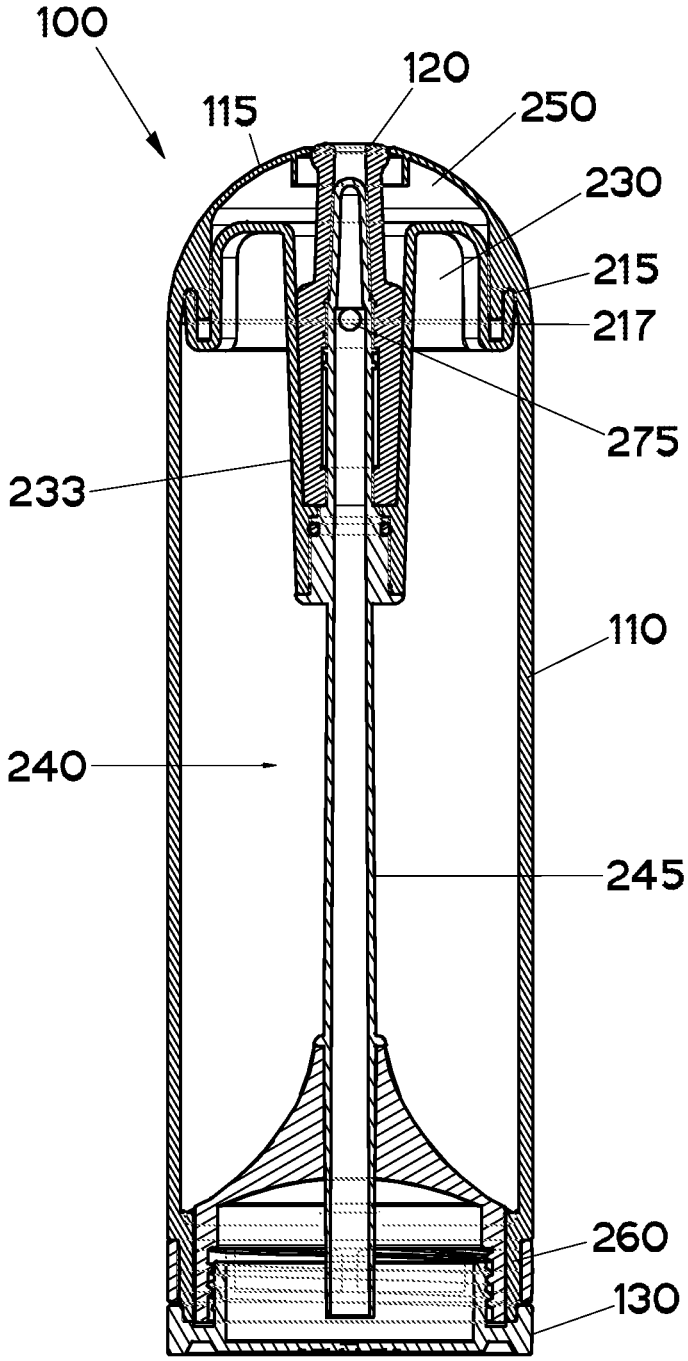
FIG. 2A illustrates a cross section of a squeezable bottle with a retractable mouthpiece according to embodiments of the present invention, with the mouthpiece in a retracted position.

FIG. 2A illustrates a cross section of a squeezable bottle with a retractable mouthpiece according to embodiments of the present invention, with the mouthpiece in a retracted position. Squeezable bottle 100 includes a flexible TPE skin 110, formed as a cylinder with a top dome. Inside the skin about the periphery of the dome a circular groove 215 is provided designed to interlock with rim 217 of dome support 230. Dome support 230 is an upper part of spinal assembly 240. Spinal assembly 240 provides the squeezable bottle vertical rigidity along the elongated axis of the bottle, preventing collapse along that axis. Spinal assembly 240 includes dome support 230 incorporating the female part 233 of mouthpiece 120 and a rigid pipe 245, which is coupled to base member 260. Dome support 230 is designed to block liquids from reaching upper chamber 250, which is a space defined between dome 115 and dome support 230, and surrounding mouthpiece 120. Base member 260 is affixed to skin 110 and cooperates with bottom sealer cap 270. Pipe 245 is used to conduct liquid from the bottom of the squeezable bottle to the mouthpiece 120. Pipe 245 includes two openings—one at the bottom and a hole 275 at the top, which is sealed by mouthpiece 120 when in the retractable position preventing liquids from flowing out through the mouthpiece.

Figure 2B:
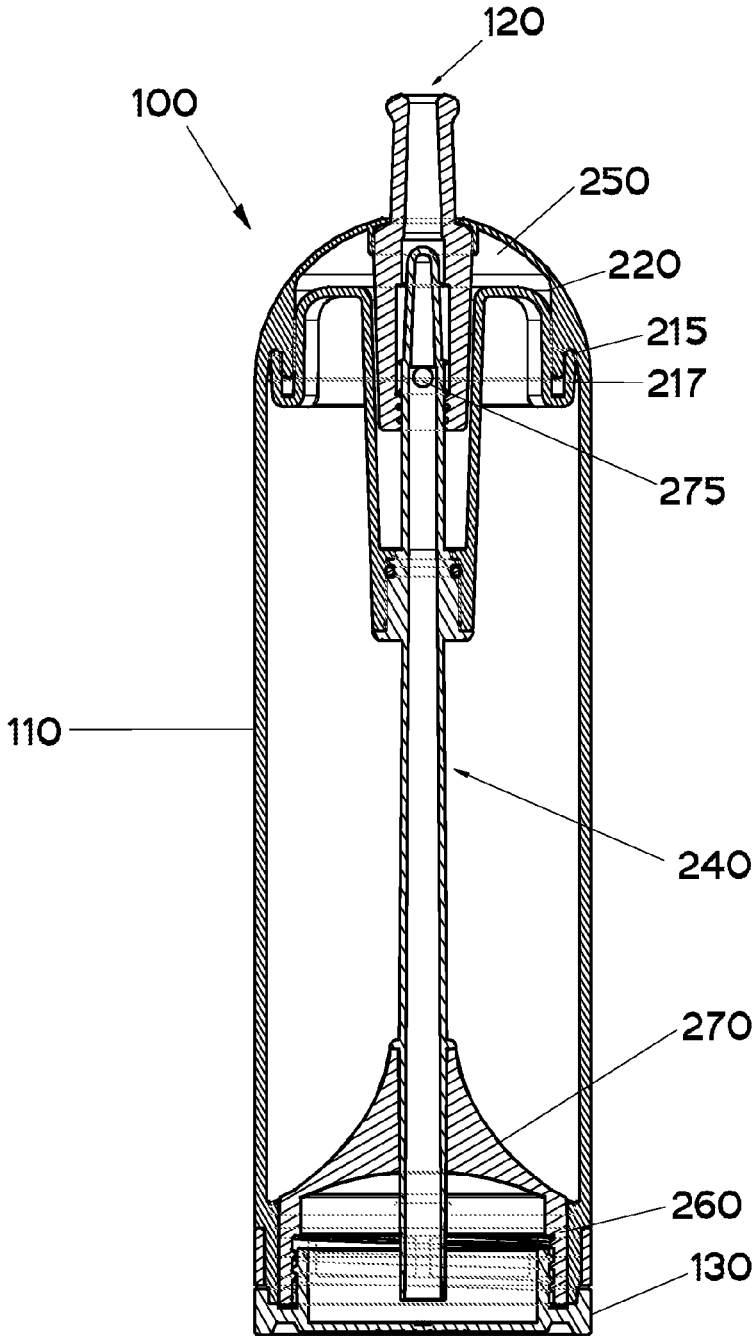
FIG. 2B illustrates a cross section of a squeezable bottle with a retractable mouthpiece according to embodiments of the present invention, with the mouthpiece in a pulled-out position.

FIG. 2B illustrates a cross section of the squeezable bottle shown in FIG. 1A, with the mouthpiece in a pulled-out position. When mouthpiece 120 is pulled out, hole 275 is open allowing the liquid inside the bottle to flow through, thus facilitating drinking by squeezing the bottle, sucking the liquid out or splashing the liquid through mouthpiece 120, using one hand to hold the bottle and squeeze it. The user thus does not have to tilt the head backwards to drink from the bottle.

Base member 260 has a internal screw thread which matches the external thread of bottom sealer cap 130, facilitating covering and uncovering of the opening at the bottom of bottle 100 for convenient refilling of the bottle.

Figure 3B:
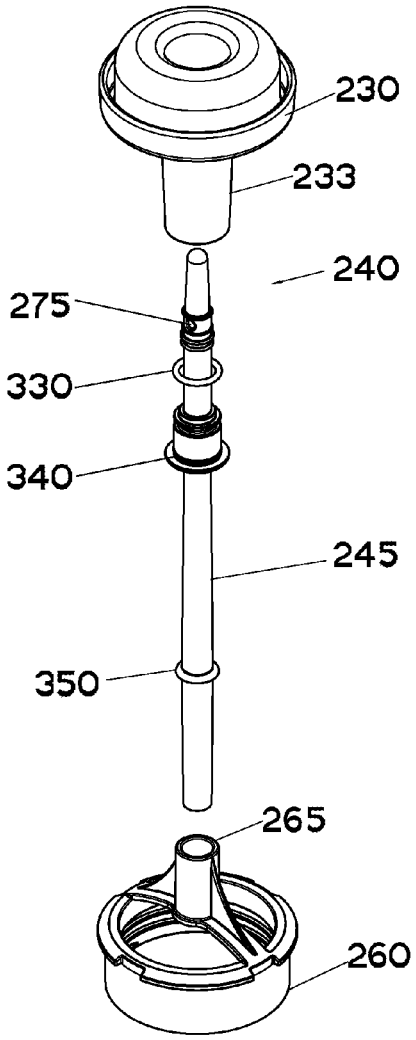
FIG. 3B is an exploded view of a spine assembly of a squeezable bottle according to embodiments of the present invention.
Figure 3A:
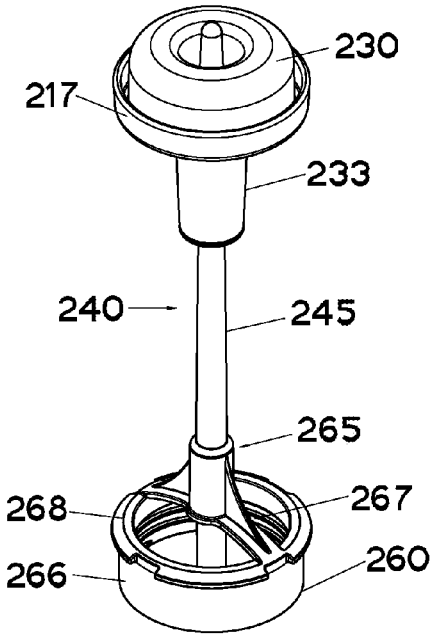
FIG. 3A illustrates a spine assembly of a squeezable bottle according to embodiments of the present invention.

FIG. 3A illustrates a spinal assembly of a squeezable bottle according to embodiments of the present invention. Spinal assembly 240 comprises dome support 230, rigid pipe 245 and base member 260. Dome support 230 has a dome form with a hollow cone structure 233 that forms the female part of mouthpiece 120. A circular rim 217 is provided to interlock with matching groove 215 in the internal surface of skin 110 (see FIG. 2A). Dome support 230 has a hollow center tube where rigid pipe 245 is threaded from one side and mouthpiece 120 extends from the other side. Pipe 245 is coupled to base member 260. Base member 260 has a holder 265, which is designed to receive pipe 245 with lateral ribs 267 extending sideways and anchored to base member 260. Base member 260 includes one or more gaps to allow liquid to be filled into the squeezable bottle through the gaps. Rigid pipe 245 is threaded through the holder 265. Outer tube 266 has annular protrusions 268 for engaging with a tightened ring (see FIG. 4A), holding the bottom edges of skin 110. Base member 260 has internal thread to match the external thread of a bottom sealer cap (130, see FIG. 5).

FIG. 3B is an exploded view of a spinal assembly of a squeezable bottle according to embodiments of the present invention. Spinal assembly 240 comprises Dome support 230, rigid pipe 245 and base member 260. Flange 340 is provided to hold dome support 230 in its proper position when pipe 245 is threaded through hollow cone structure 233. Washer 330 (e.g. O-ring) is used to prevent leakage from within the bottle to the mouthpiece when in a retracted state. Similarly, flange 350 serves as a stopper to support pipe 245 at a proper, predetermined height over base member 260, when the pipe is inserted in holder 265.

Figure 4B:
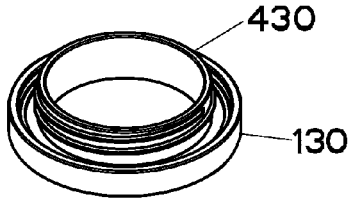
FIG. 4B illustrates a bottom cap of a squeezable bottle according to embodiments of the present invention.
Figure 4A:
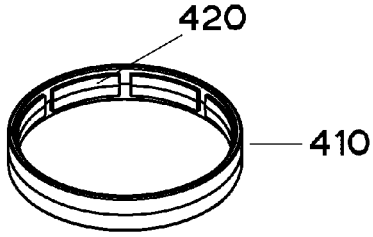
FIG. 4A illustrates a tightening ring of a squeezable bottle according to embodiments of the present invention.

FIG. 4A illustrates a tightened ring of a squeezable bottle according to embodiments of the present invention. Tightened ring 410 is tightened firmly to affix the bottle skin to the squeezable bottle spine assembly and is typically placed in place during manufacturing of the bottle. The skin is held in position by protrusions 268 (see FIG. 3A) which are pressed against matching dents 420 provided on the internal surface of the tightening ring 410.

In some embodiments of the present invention the squeezable bottle spine assembly may be designed to be removably installed in the squeezable bottle skin 210 in regular daily use by customers, allowing removing or replacing the spinal assembly from the bottle.

FIG. 4B illustrates a bottom sealer cap designed for a squeezable bottle according to embodiments of the present invention. Bottom sealer cap 130 has an external thread 430 matching the internal thread of the base member 260 (see FIG. 3A). By unscrewing and removing bottom sealer cap it is possible to fill, the squeezable bottle, refill it or empty it from liquids. Screwing the bottom sealer cap 130 back in position ensures that the bottom opening of the squeezable bottle is sealed again, preventing leakage from the bottom opening. With the bottom sealer cap 130 it is possible to manufacture the entire skin of the squeezable bottle in one piece. The skin of the squeezable bottle presents a uniform surface which is pleasant for the holding and convenient for squeezing.

Figure 5:
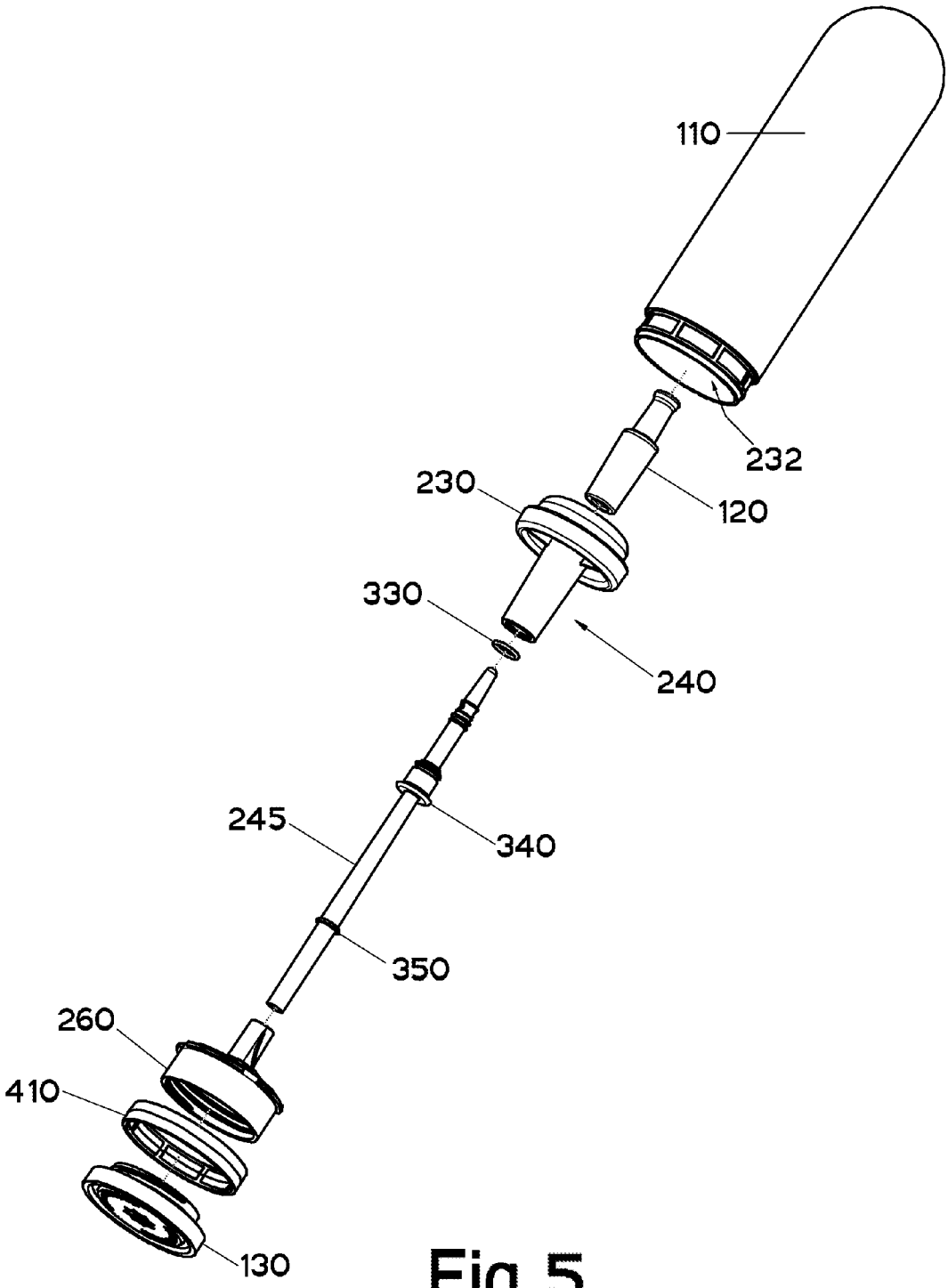
FIG. 5 is an exploded view of a squeezable bottle according to embodiments of the present invention.

FIG. 5 is an exploded view of a squeezable bottle according to embodiments of the present invention. The spinal assembly 240 is inserted into the space within skin 110 of the squeezable bottle through bottom opening 232 and the tightening ring 410 is firmly fixed onto base member 260 with the edges of skin 110 in between. Bottom sealer cap 130 is then screwed in position at the bottom of the bottle.

A squeezable bottle, according to embodiments of the present invention may be made in various sizes, with the ease of use in mind.

A squeezable bottle, according to embodiments of the present invention may be designed with a fixed mouthpiece, with or without a closure mechanism. For example, the mouthpiece may include a bite valve or other valve mechanism to prevent dispensing of the liquid inside the bottle through the mouthpiece, when not in use.

A squeezable bottle, according to embodiments of the present invention may be provided in various colors.

A squeezable bottle, according to embodiments of the present invention may be suitable for outdoor use, or for home and office use.

What is claimed is:

1. A squeezable bottle, comprising:

a pliable bottle skin; and a spinal assembly within the pliable skin, for providing longitudinal rigidity along an elongated axis of the bottle, the spinal assembly comprising a pipe having two openings, one at the bottom of the bottle and another at the top of the bottle, with an outlet at the top of the bottle, so that when the pliable bottle skin is squeezed laterally across the bottle, liquid within the bottle is squeezed out of the bottle through the pipe and the outlet;

wherein the spinal assembly is provided with a base member, with one or more gaps allowing refilling the bottle through said one or more gaps.

2. A squeezable bottle as claimed in claim 1, wherein the outlet comprises a mouthpiece.

3. A squeezable bottle as claimed in claim 2, wherein the mouthpiece is a retractable mouthpiece.

4. A squeezable bottle as claimed in claim 3, wherein said retractable mouthpiece has a retracted position in which the liquid cannot be dispensed from the bottle through the mouthpiece and a pulled-out position in which the liquid can be dispensed through the mouthpiece.

5. A squeezable bottle as claimed in claim 1, wherein the pliable bottle skin comprises a top dome.

6. A squeezable bottle as claimed in claim 1, wherein the spinal assembly includes a base member and a dome support.

7. A squeezable bottle as claimed in claim 6, wherein a space is provided between a top portion of the skin and the dome support, allowing pressing the top portion of the skin to expose the outlet.

8. A squeezable bottle as claimed in claim 1, comprising a bottom sealable opening.

9. A squeezable bottle as claimed in claim 8, wherein a sealer cap is provided for removably sealing the bottom sealable opening.

10. A squeezable bottle as claimed in claim 1, wherein a rim and matching groove are provided to interlock the spinal support with the skin.

11. A squeezable bottle as claimed in claim 1, comprising a tightening ring for fixing edge of the skin to the spinal assembly.

12. A squeezable bottle as claimed in claim 1, wherein the squeezable bottle skin is made of a thermoplastic elastomer.

13. A squeezable bottle as claimed in claim 1, wherein the spinal assembly is removable from the bottle.

14. A squeezable bottle, comprising:

a pliable bottle skin; and a spinal assembly within the pliable skin, for providing longitudinal rigidity along an elongated axis of the bottle, the spinal assembly comprising a pipe having two openings, one at the bottom of the bottle and another at the top of the bottle, with an outlet at the top of the bottle, so that when the pliable bottle skin is squeezed laterally across the bottle, liquid within the bottle is squeezed out of the bottle through the pipe and the outlet, wherein the spinal assembly includes a base member and a dome support, and wherein a space is provided between a top portion of the skin and the dome support, allowing pressing the top portion of the skin to expose the outlet.

* * * * *